United States Patent [19]

Fuggini et al.

[11] Patent Number: 4,948,531

[45] Date of Patent: Aug. 14, 1990

[54] LIQUID ONE-STEP HARD SURFACE CLEANING/PROTECTOR COMPOSITIONS

[75] Inventors: Cynthia L. Fuggini, Florida, N.Y.; Allan L. Streit, River Vale, N.J.

[73] Assignee: Sterling Drug Incorporated, New York, N.Y.

[21] Appl. No.: 275,246

[22] Filed: Nov. 22, 1988

[51] Int. Cl.[5] ..... C11D 3/04; C11D 7/00

[52] U.S. Cl. ..... 252/544; 252/135; 252/158; 252/174.15; 252/174.21; 252/174.22; 252/545; 252/548; 252/546

[58] Field of Search ..... 252/174.21, 174.22, 252/545, 548, 546, 174.15, 158, 135; 106/3

[56] References Cited

U.S. PATENT DOCUMENTS

| | | | |
|---|---|---|---|
| 3,960,575 | 6/1976 | Martin . | |
| 4,105,574 | 8/1978 | Culmone et al. . | |
| 4,179,414 | 10/1979 | Clayton | 252/548 |
| 4,218,250 | 8/1980 | Kasprzak . | |
| 4,246,029 | 1/1981 | Sanders, Jr. . | |
| 4,247,424 | 1/1981 | Kuzel et al. . | |
| 4,289,640 | 9/1981 | Falivene | 252/140 |
| 4,396,525 | 8/1983 | Rubin et al. . | |
| 4,439,344 | 3/1984 | Albanese . | |
| 4,486,328 | 12/1984 | Knott et al. . | |
| 4,699,807 | 10/1987 | Howell | 106/3 |
| 4,797,231 | 1/1989 | Schumann et al. | 252/171 |
| 4,810,407 | 4/1989 | Sandvick | 252/174.15 |

*Primary Examiner*—Christine M. Nucker
*Assistant Examiner*—Eric Steffe
*Attorney, Agent, or Firm*—John R. Everett

[57] ABSTRACT

Compositions for cleaning hard surfaces, which are formulated to leave on the surface simultaneously with the cleaning thereof a protective barrier layer which serves to protect the surface against further soil deposition, comprising: (A), as cleaning agents, from one to two nonionic surfactants and an amphoteric surfactant; (B), as protective barrier components, lecithin and an aminofunctional polydimethylsiloxane copolymer; (C), as solvency and grease cutting agents, from one to two glycols; and (D) water.

6 Claims, No Drawings

LIQUID ONE-STEP HARD SURFACE CLEANING/PROTECTOR COMPOSITIONS

BACKGROUND OF THE INVENTION

This invention relates to cleaning compositions for removal of dirt and grease from hard surfaces which leave behind a substantive anti-stick barrier to protect the surface against further soil deposition.

INFORMATION DISCLOSURE STATEMENT

Martin U.S. Pat. No. 3,960,575 discloses polishing compositions having improved detergent resistance containing from 1 to 15 weight percent, and preferably from 2 to 10 weight percent, of an "aminofunctional silicon fluid" and from 1 to 30 weight percent, and preferably from 2 to 25 weight percent, of an hydroxyl-terminated organopolysiloxane and/or a silicone resin incorporated in a wax-containing polish composition containing from 2 to 10 weight percent wax. The compositions are said to impart improved detergent resistance and improved rub-out properties thereto and to provide improved gloss to surfaces treated therewith. The compositions, which may also contain up to 5 weight percent of an emulsifying agent, may be formulated either as organic solvent based, aqueous emulsion type or paste wax type polishes.

Culmone et al U.S. Pat. No. 4,105,574 discloses a non-caustic oven cleaner comprising monoethanolamine, an etherified alkylene glycol solvent, a synthetic, hydrous sodium magnesium silicate gelling agent and water. Nonionic or anionic surfactants can also be incorporated, especially in aerosol generated compositions, to produce a foam which sticks to preheated oven walls. Preferred nonionic surfactants are those of the ethoxylated nonyl phenol or alkylaryl polyethylene glycol ether types, and preferred anionics are those of the ammonium ethoxylated $C_{12}$–$C_{15}$ alcohol sulfate or the sodium linear alkyl sulfonate types.

Kasprzak U.S Pat. No. 4,218,250 discloses polish formulations containing wax and/or an abrasive, and optionally solvents, surfactants, thickening agents, detergent resistant additives, colorants or odorants, (a) from 5 to 60 weight percent of a cyclodimethylsiloxane fluid, (b) from 0.5 to 10 weight percent of a polydiorganosiloxane-polyalkylene copolymer and (c) from 30 to 95 weight percent water. The compositions can also contain from 0.5 to 5 weight percent of an organic water-in-oil surfactant having an HLB value of from 2 to 10 and a silicone-glycol copolymer.

Sanders U.S. Pat. No. 4,246,029 discloses detergent resistant coating compositions containing an aqueous emulsion of (1) a mixture of silicone fluids consisting of (a) an aminofunctional silicone fluid and (b) an organopolysiloxane fluid and (2) a mixture of surface active agents consisting of (a) an octylphenoxy polyethoxy ethanol containing from 1 to 13 mols of ethylene oxide and (b) an ethylene oxide reaction product of nonyl phenol with from 6 to 40 mols of ethylene oxide and (3) the balance water. The compositions, when applied to vinyl surfaces, are said to produce a high gloss coating which is resistant to detergents.

Kuzel et al. U.S. Pat. No. 4,247,424 discloses stable, liquid detergent emulsion compositions containing (1) an ethoxylated alcohol or ethoxylated alkyl phenol nonionic surfactant, (2) an amine oxide surfactant, (3) a water soluble sequestering detergency builder, (4) a hydrophobic emulsifier and (5) water. Suitable hydrophobic emulsifiers are said to be "alkali metal, ammonium and mono-, di-, and tri-$C_{1-4}$ alkyl and alkane ammonium salts of dialkyl sulfosuccinic acid, . . . quaternary ammonium compounds with more than one alkyl group each containing at least 8 carbon atoms, . . . di-$C_{12-18}$ alkyl imidazolinium quaternary ammonium compounds . . . alkyl or alkyl ethoxy diesters of phosphoric acid . . . (and) Lecithin", and it is stated that a fatty acid amide surfactant can be used as an optional surfactant component to act as a suds modifier, which serves to boost the sudsing in a system which exhibits low sudsing.

Rubin et al. U.S. Pat. No. 4,396,525 discloses liquid scouring compositions containing, as essential ingredients, an anionic surfactant, an amphoteric surfactant, an abrasive, an electrolyte and water. It is stated that the amphoteric surfactant replaces nonionic surfactants which are conventionally used in such compositions in the prior art. The amphoteric surfactant is said to act as a co-surfactant with the anionic surfactant to form the micellar structure needed to support the abrasive. It thus promotes easy rinsing from surfaces of the abrasive-bearing compositions and improved cleaning power. The electrolytes used consist of "alkali metal sulfates, alkali metal carbonates or bicarbonates, alkali metal halides, silicates and citrates . . . alkali metal and alkaline earth salts of ethylene diamine tetraacetic acid, alkali metal nitrates and mixtures thereof".

Albanese U.S. Pat. No. 4,439,344 discloses a water based, two-phase dispersion for providing a continuous, even film or coating on surfaces wherein the coating agent is selected from a wide variety of materials, and the critical dispersal agent is a cocodiethanolamide having particular physical properties and which must be used in a critical amount of from 2.5 to 10 weight percent of the total composition.

Knott et al. U.S. Pat. No. 4,486,328 discloses clear liquid shampoo compositions consisting essentially of (a) from 6 to 24 weight percent of a mixture of a water soluble zwitterionic detergent and a water-soluble salt of a $C_{10}$–$C_{18}$ carboxylic acid, the ratio of the zwitterionic detergent: carboxylic acid salt being from 1.2:1 to 2.3:1, and (b) from 1 to 8 weight percent of a $C_8$–$C_{18}$ carboxylic acid $C_2$–$C_3$ alkanolamide in an aqueous medium. The shampoos, being free of anionic surfactants which are irritating to the skin, are said to be milder to the skin than shampoos containing anionics.

Kirk-Othmer Encyclopedia of Chemical Technology, Vol. 14. (3rd Edition), pages 266–267 discloses the use of lecithin as a surfactant, anti-stick agent for coating utensils and as a release agent.

SUMMARY OF THE INVENTION

In a composition aspect, the invention resides in cleaning compositions comprising (A), as cleansing components, from one to two nonionic surfactants and an amphoteric surfactant; (B), as protective barrier components, lecithin and an aminofunctional polydimethylsiloxane copolymer; (C), as a solvency and grease cutting agent, an organic glycol solvent; and (D) water.

DETAILED DESCRIPTION OF THE PREFERRED EMBODIMENTS

More specifically, and in accordance with the foregoing, the present invention relates to liquid cleaning compositions for cleaning hard surfaces which are formulated to leave on the surface simultaneously with the cleaning thereof a protective barrier layer which serves to protect the surface against further soil deposition comprising: (A) (i) from one to two nonionic surfactants selected from the group consisting of a polyethylene glycol alkylphenyl ether having the formula

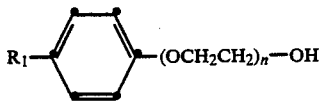

I where $R_1$ is $C_8$–$C_9$ straight or branched chain alkyl and n is an integer from 5 to 13, a polyethylene glycol long chain alkyl ether having the formula:

$$R_2—(OCH_2CH_2)_n—OH$$

where $R_2$ is $C_9$–$C_{15}$ straight chain or secondary alkyl and n has the meanings given above, a saturated or unsaturated fatty acid mono- or diethanolamide having the formulas IIIa or IIIb:

$$R_3—CONH—CH_2CH_2OH \quad \text{IIIa}$$

$$R_3—CON(CH_2CH_2OH)_2 \quad \text{IIIb}$$

and a saturated or unsaturated fatty acid monoisopropanolamide having the formula IIIc:

$$R_3—CONH—CH_2CHOHCH_3 \quad \text{IIIc}$$

where $R_3$ in all instances, is a $C_9$–$C_{17}$ alkane, alkene or alkadience group, and (ii) an amphoteric surfactant having the formulas IVa or IVb:

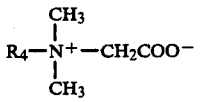

IVa where $R_4$ is $C_6$–$C_{18}$ alkyl or alkenyl,

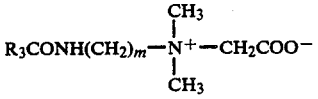

IVb where $R_5$ is $C_{11}$–$C_{17}$ alkyl and m is one of the integers 2 and 3 (B) lecithin and an aminofunctional polydimethylsiloxane copolymer having the formula:

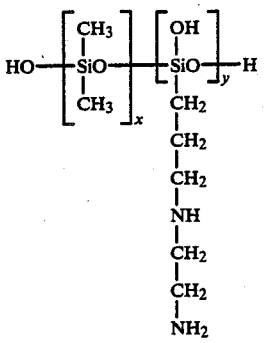

V (C) from one to two glycols having one of the formulas VIa or VIb:

$$R_6(OCH_2CH_2)_p—OH \quad \text{VIa}$$

$$R_6(OCH(CH_3)CH_2)_pOH \quad \text{VIb}$$

where $R_6$ is hydrogen or $C_1$–$C_2$ lower-alkyl, and p is one of the integers 1 and 2; and (D) water.

In a preferred aspect, the invention relates to liquid cleaning compositions as described above comprising: (A) from 2.0 to 15.0 percent of up to two of the nonionic surfactants of Formulas I, II, IIIa, IIIb and IIIc and an amphoteric surfactant of Formulas IVa or IVb; (B) from 0.070 to 3.0 percent of lecithin and from 0.50 to 10.0 percent of an aminofunctional polydimethylsiloxane copolymer of Formula V; (C) from 1.0 to 20.0 percent of from one to two glycols of Formulas VIa and VIb; and (D) the balance water, the percentages, in all instances, being in percent by weight of the various ingredients in the total weight of the composition In a further preferred aspect, the invention relates to cleaning compositions, as described above, comprising: (A) from 0.75 to 5.0 percent each of a polyethylene glycol alkylphenyl ether of Formula I, an alkanediethanolamide of Formula IIIb and an alkanamido alkylene dimethyl betaine surfactant of Formula IVb; (B) from 0.075 to 1.05 percent of lecithin an from 0.50 to 10.0 percent of an aminofunctional polydimethylsiloxane copolymer of Formula V; (C) from 1.0 to 10.0 percent each of from one to two propylene glycols of Formula VIb; and (D) the balance water.

In a particularly preferred aspect, the invention relates to liquid cleaning compositions, as described above, comprising: (A), as the nonionic and amphoteric surfactants, about 2.0 percent of a polyethylene glycol alkylphenyl ether of Formula I, about 2.0 percent of an alkanediethanolamide of Formula IIIb and about 0.88 percent of a alkanamido alkylene dimethyl betaine of Formula IVb; (B) about 0.17 percent lecithin, about 1.0 percent of an aminofunctional polydimethylsiloxane copolymer of Formula V; (C) about 6.0 percent of from one to two propylene glycols of Formula VIb; and (D) the balance water.

The polyethylene glycol alkylphenyl ethers of Formula I are well known in commerce, examples thereof being sold under the Rohm and Haas (Philadelphia, Pa.) tradenames TRITON® X and TRITON® N or the GAF Corporation (Wayne, N.J.) tradenames IGEPAL® CA and IGEPAL® CO and which are identified by the CTFA adopted names of octoxynols and nonoxynols. These include, for example, octoxynol-7, octoxynol-9 (TRITON®-X-100), octoxynol-10 and octoxynol-13 where $R_1$ in Formula I is $CH_3C(CH_3)_2CH_2C(CH_3)_2$— and n has an average value of 7, 9, 10 and 13, respectively, and nonoxynol-7, nonoxynol-8, nonoxynol-13, etc., where R in Formula I is $C_9H_{19}$ and n has an average value of 7, 8 and 13, respectively.

The polyethylene glycol long chain alkyl ethers of Formula II above are also commercially available Examples thereof are sold under the Shell Chemical Co. (Houston, Tex) tradename NEODOL® 45 and are identified by the CTFA adopted name pareth-45. Suitable members of the group for the practice of the present invention are pareth-45-7, pareth-45-11 and pareth-45-13, where $R_2$ in Formula II is the residue of a mixture of synthetic $C_{14}$–$C_{15}$ alcohols and n has an average value of 7, 11 and 13, respectively.

The saturated or unsaturated fatty acid mono- or diethanolamides of Formulas IIIa/IIIb and the saturated or unsaturated fatty acid monoisopropanolamides of Formula IIIc are also well known in commerce. Examples thereof are sold under the Henkel Inc. (Teaneck, N.J.) tradenames STANDAMIDE® CD, KD and SM (corresponding to capryldiethanolamide, cocodiethanolamide and cocomonoethanolamide, respectively) and COMPERIAN® LM, LP and F (corresponding to laurylmonoethanolamide, laurylmonoisopropanolamide and lauryldiethanolamide, respectively); Scher Chemicals Inc. (Clifton, N.J.) tradenames SCHERCOMID® CMI, ID, IME, OMI and SME (corresponding to cocomonoisopropanolamide, isostearyldiethanolamide, isostearylmonoethanolamide, oleylmonoisopropanolamide and stearylmonoethanolamide, respectively); Mona Industries Inc. (Patterson, N.J.) tradenames MONAMID® 150MW and 835 (corresponding to myristyldiethanolamide and linolmonoisopropanolamide, respectively); Lonza Inc. (Fairlawn, N.J.) tradenames CARSAMIDE® MMEA and O (corresponding to myristylmonoethanolamide and oleyldiethanolamide, respectively) and UNAMIDE® S (corresponding to stearyldiethanolamide); and Witco Chemical Corporation (New York, N.Y.) tradename WITCAMIDE® 511 (corresponding to oleyldiethanolamide).

The amphoteric surfactants of Formulas IVa and IVb are also readily available in commerce, examples thereof being sold under the Lonza Inc. (Fairlawn, N.J.) tradenames LONZAINE® 10S, 12C, 14, 16S and 18S (corresponding to decyl betaine, coco betaine, lauryl betaine, cetyl betaine and stearyl betaine, respectively); Scher Chemicals Inc. (Clifton, N.J.) tradenames SCHERCOTAINE®, SCHERCOTAINE® MAB, OB and PAB (corresponding to stearamidopropyl betaine, myristamidopropyl betaine, oleyl betaine and palmamidopropyl betaine, respectively); and Inolex Chemical Co. (Philadelphia, Pa.) tradename LEXAINE® CG-30 (corresponding to cocamidopropyl betaine).

The aminofunctional polydimethylsiloxane copolymers of Formula V are members of a family of such copolymers developed by the Dow Corning Corporation, Midland, Mich. The preparation of the copolymers is described in Kasprzak U.S. Pat. No. 4,218,250, Martin U.S. Pat. No. 3,960,575 and Sanders U.S. Pat. No. 4,246,029, the disclosures of which are incorporated herein by reference. The copolymers are marketed by Dow Corning under the generic name amodimethicones, and a particularly preferred copolymer for the practice of the present invention is the Dow Corning amodimethicone 531 fluid which is sold as a 50% solution in aliphatic solvents and isopropyl alcohol having a viscosity and specific gravity at 77° F. (25° C.), cSt, of 150 cps and 0.860 g/cc.

The glycols of Formulas VIa and VIb are also well known in commerce, for example ethylene glycol and propylene glycol. Other examples thereof are sold under Dow Chemical U.S.A. (Midland, Mich.) tradenames DOWANOL® DE, EE, DM and EM (corresponding to diethylene glycol monoethyl ether, ethoxyethanol, diethylene glycol monomethyl ether and methoxyethanol, respectively) and under the Arco Chemical Co. (Philadelphia, Pa.) tradename ARCOSOLV® DPM (corresponding to dipropylene glycol monomethyl ether).

The compositions may, in order to provide additional benefits, optionally contain non-essential ingredients such as fragrances, dyes, preservatives, abrasives and pH adjusters and builders For example, sodium ethylenediamine tetraacetate serves as both a pH adjuster and a detergency builder. It is preferred that the pH of the compositions of the present invention be adjusted, for example with tetra sodium ethylenediamine tetraacetic acid, to a pH in the range from 9.5–11.0. Generally fragrances, preservatives and abrasives may be used in amounts up to 1.0 percent each, dyes in amounts up to 0.50 percent and pH adjusters and builders in amounts up to 3.0 percent.

The compositions of the invention are prepared by mixing a first mixture consisting of a fatty acid mono- or diethanolamide of Formulas IIIa or IIIb or a fatty acid mono-isopropanolamide of Formula IIIc, if used, lecithin and the aminofunctional polydimethylsiloxane copolymer of Formula V by thorough mixing of the components thereof. A second mixture consisting of a polyethylene glycol alkylphenyl ether of Formula I and/or a polyethylene glycol long chain alkyl ether of Formula II, an amphoteric surfactant of Formulas IVa or IVb, the glycol solvents of Formulas VIa and VIb, any fragrances, dyes, perservatives, abrasives and pH adjusters and/or builders together with tap water is prepared by thorough mixing of the ingredients thereof. Thereafter the second mixture is added slowly and with stirring to the first mixture, preferably using a homogenizer, to produce the desired emulsion.

The manner and process of making and using the invention and the best mode contemplated by the inventors for carrying out the invention will now be described so as to enable the person skilled in the art to which it pertains to make and use the same.

EXEMPLARY DISCLOSURE

A formulation composed as shown in the table below was prepared as described above.

| Ingredient | Amt. | Wght. % Actives |
|---|---|---|
| Propylene glycol | 4.0 | 4.00 |
| Dipropylene glycol monomethyl ether | 2.0 | 2.00 |
| Oleic acid diethanolamide | 2.0 | 2.00 |
| TRITON® X-100 (octoxynol-9) | 2.0 | 2.00 |
| Cocamidopropyl betaine (35% in $H_2O$) | 2.5 | 0.88 |
| Lecithin (ca. 33% in propylene glycol) | 0.5 | 0.17 |
| Dow Corning 531 Fluid (50%) | 2.0 | 1.00 |
| Fragrance | 0.5 | 0.50 |
| Sodium EDTA (38% in $H_2O$) | 1.5 | 0.57 |
| Water | — | 86.88 |

Test Method 1 described below was used to test the formulation described above for its resistance to removal by washing when applied to hard surfaces, and Test Method 2 described below was used to test the formulation for its ability, once applied to a surface, to protect the surface from soil deposition.

Test Method 1

In this test, designed to assess the resistance of test formulations to removal by washing when the formulations are applied to hard surfaces such as stove tops, one week of washings and one washing per meal is defined as:

*7 days/week×3 meals/day=21 washings/week.*

To simulate an in-use washing procedure, a Gardner Washability Apparatus (Pacific Scientific, Gardner Laboratories Div., Silver Spring, Md.) was programmed to pass a damp sponge moistened with 50 g. of water over a treated surface for a pre-set number of cycles, each cycle consisting of two passes of the sponge over the surface. It is assumed that, in actual home use, each washing would consist of 10 passes (or 5 cycles by the Gardner Washability Apparatus) of a cleaning sponge over the treated surface Thus the total cycles per week is:

*21 washings/week×5 cycles/washing=105 cycles/week.*

A measure of the resistance to removal by washing over a one week period is obtained by dipping a glazed white enamel test tile, pretreated with the test formulation, in mineral oil, optionally containing an oil soluble dye, such as Nitro Fast Red B (Sandoz Inc., East Hanover, N.J.) to enhance visibility, and observing how well the oil beads on the surface and repeating the test after subjecting the treated tile to 105 wash cycles on the Gardner Washability Apparatus. The presence or absence of a protective film was determined by the degree of oil beading on the tiles, the greater the amount of beading the more protective film present. The test procedure was carried out three times using three tiles in each test procedure, and the results were compared with results obtained using three untreated tiles as controls. A panel of five people evaluated each of the control and test tiles in each of the three tests, and all five individuals scored the tiles as follows (NB representing no beading, indicating the absence of a protective film, and SB representing substantial beading, indicating the presence of a protective film.)

| | Test 1 | Test 2 | Test 3 |
|---|---|---|---|
| Control | N.B. | N.B. | N.B. |
| Treated/unwashed | S.B. | S.B. | S.B. |
| Treated/washed | S.B. | S.B. | S.B. |

Thus the formulation of the invention described above was determined to provide significant resistance to removal by washing over a one week period of typical use conditions Test Method 2

In this test, designed to assess the ability of test formulations to protect surfaces on which they have been deposited from soil deposition, three sets of tiles, three tiles per test, were used. One set of tiles, used as controls, was washed with water only; a second set was treated with the formulation of the invention described above; and a third set was treated with the same test formulation and then subjected to the equivalent of one week of washings on the Gardner Washability Apparatus as described above. All three sets were then spread with two grams of a highly tenacious food soil consisting of an aqueous dispersion of mustard and flour and then baked in an oven at 170° C. (350° F.) for 10 minutes The tiles were then subjected to 10 washing cycles (i.e. two typical home use washing operations) with the Gardner Washability Apparatus as described above. As in Test Method 1, the test procedure was carried out a total of three times to provide a total of 9 tiles for each of the control, treated and unwashed and treated and washed sets.

The thus treated tiles were evaluated both instrumentally and visually In the instrumental evaluation, a Gardner Color Gard 45/0 reflectometer was used to measure the reflectance of each of the tiles. The results, expressed in percent reflectance, are given in Table 1 below for each of the 9 tiles, each value being an average of the three separate tests:

TABLE 1

| Tile No. | Control | Treated Unwashed | Treated Washed |
|---|---|---|---|
| 1 | 64.0 | 77.7 | 68.5 |
| 2 | 56.7 | 70.2 | 70.3 |
| 3 | 56.4 | 57.0 | 65.4 |
| 4 | 64.0 | 64.6 | 63.5 |
| 5 | 52.6 | 64.3 | 64.9 |
| 6 | 47.4 | 52.7 | 57.7 |
| 7 | 39.5 | 41.4 | 51.6 |
| 8 | 62.4 | 64.1 | 73.1 |
| 9 | 61.5 | 72.2 | 74.0 |
| Average | 56.1 | 62.7 | 65.4 |
| Stand. Dev. | 8.3 | 11.0 | 7.2 |

The visual evaluation was carried out by a panel of five people who assigned a number from 1 (completely clean) to 5 (completely soiled) to each of the 9 test panels for each of three tests. The results are given in Table 2 below, where each value is the average value assigned by the five panelists for the three tests, i.e. an average of 15 assigned values.

TABLE 2

| Tile No. | Control | Treated Unwashed | Treated Washed |
|---|---|---|---|
| 1 | 4.8 | 2.6 | 3.2 |
| 2 | 5.0 | 3.6 | 2.6 |
| 3 | 4.2 | 3.0 | 3.6 |
| 4 | 4.8 | 4.4 | 3.0 |
| 5 | 4.4 | 1.8 | 2.6 |
| 6 | 3.0 | 2.6 | 3.4 |
| 7 | 5.0 | 3.6 | 4.2 |
| 8 | 4.2 | 2.8 | 2.6 |
| 9 | 3.8 | 1.2 | 2.2 |
| Average | 4.4 | 2.8 | 3.0 |
| Stand. Dev. | 0.65 | 0.97 | 0.62 |

These data show, by the high reflectance values given in Table 1 and by the lower scores assigned in Table 2, that the formulation of the invention provides effective protection against soil deposition on surfaces which have been either treated with the formulation and left unwashed or which have been treated with the formulation and subjected to the equivalent of a 3 times daily cleaning for a period of one week.

In use, the compositions of the invention can either be applied directly to a surface to be cleaned or to a cleaning sponge or pad, for example from a spray bottle dispenser, and the sponge or pad used to wipe the surface clean.

We claim:

1. A liquid cleaning composition for cleaning hard surfaces consisting essentially of:

(A) (i) from 2.0 to 15.0 percent of from one to two nonionic surfactants selected from the group consisting of a polyethylene glycol alkylphenyl ether having the formula:

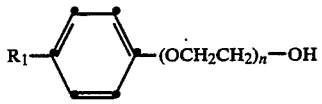

I where $R_1$ is $C_8$–$C_9$ straight or branched chain alkyl and n is an integer from 5 to 13, a polyethylene glycol long chain alkyl ether having the formula:

$$R_2—(OCH_2CH_2)_n—OH \quad \text{II}$$

where $R_2$ is $C_9$–$C_{15}$ straight chain or secondary alkyl and n has the meanings given above, a saturated or unsaturated fatty acid mono- or diethanolamide having the formulas IIIa or IIIb:

$$R_3—CONH—CH_2CH_2OH \quad \text{IIIa}$$

$$R_3—CON(CH_2CH_2OH)_2 \quad \text{IIIb}$$

and a saturated or unsaturated fatty acid monoisopropanolamide having the formula IIIc:

$$R_3—CONH—CH_2CHOHCH_3 \quad \text{IIIc}$$

where $R_3$, in all instances is a $C_9$–$C_{17}$ alkane, alkene or alkadiene group, and (ii) an amphoteric surfactant having the formulas IVa or IVb:

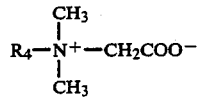

IVa where $R_4$ is $C_6$–$C_{18}$ alkyl or alkenyl,

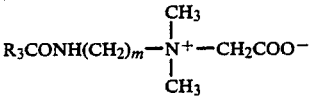

IVb where $R_5$ is $C_{11}$–$C_{17}$ alkyl and m is one of the integers 2 and 3;

(B) from 0.07 to 3.0 percent of lecithin and from 0.50 to 10.0 percent of an aminofunctional polydimethylsiloxane copolymer having the formula:

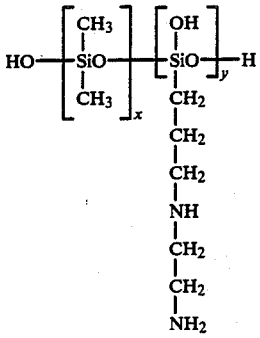

V (C) from 1.0 to 20.0 percent of from one to two glycols having one of the formulas VIa or VIb:

$$R_6(OCH_2CH_2)_p—OH \quad \text{VIa}$$

$$R_6(OCH(CH_3)CH_2)_pOH \quad \text{VIb}$$

where $R_6$ is hydrogen or $C_1$–$C_2$ lower-alkyl and p is one of the integers 1 to 2; and (D) the balance water.

2. A composition according to claim 1 consisting essentially of (A) from 0.75 to 5.0 percent each of a polyethylene glycol alkyl-phenyl ether of Formula I, an alkanediethanolamide of Formula IIIb and an alkaneamido alkylene dimethyl betaine of Formula IVb; (B) from 0.075 to 1.05 percent of lecithin and from 0.50 to 10.0 percent of an aminofunctional polydimethylsiloxane copolymer of Formula V; (C) from 1.0 to 10.0 percent each of from one to two propylene glycols of Formula VIb; and (D) the balance water.

3. A composition according to claim 2 consisting essentially of: (A) about 2.0 percent of a polyethylene glycol alkylphenyl ether of Formula I, about 2.0 percent of an alkanediethanolamide of Formula IIIb and about 0.88 percent of an alkaneamido alkylene dimethyl betaine of Formula IVb; (B) about 0.17 percent of lecithin, about 1.0 percent of an aminofunctional polydimethysiloxane copolymer of Formula V; (C) about 6.0 percent of from one to two propylene glycols of Formula VIb; and (D) the balance water.

4. A composition according to claim 3 consisting essentially of: (A) about 2.0 percent of octoxynol-9, about 2.0 percent of oleyldiethanolamide and about 0.88 percent of cocoamidopropyl betaine; (B) about 0.17 percent lecithin, about 1.0 percent of an aminofunctional polydimethylsiloxane copolymer; (C) about 4.0 percent propylene glycol and about 2.0 percent dipropylene glycol monomethyl ether; and (D) the balance water.

5. A composition according to claim 1 consisting essentially of: (A) from about 0.75 to 5.0 percent each of a polyethylene glycol alkylphenyl ether of Formula I, an alkanediethanolamide of Formula IIIb and an alkaneamido alkylene dimethyl betaine of Formula IVb; (B) from about 0.075 to 1.05 percent of lecithin and from about 0.5 to 10.0 percent of an aminofunctional polydimethylsiloxane copolymer of Formula V; (C) from about 1:0 to 10.0 percent each of from one to two propylene glycols of Formula VIb; and (D) the balance water.

6. A composition according to claim 5 consisting essentially of: (A) about 2.0 percent of octoxynol-9, about 2.0 percent of oleyldiethanolamide and about 0.88 percent of cocoamidopropyl betaine; (B)about 0.17 percent lecithin, about 1.0 percent of an aminofunctional polydimethylsiloxane copolymer; (C) about 4.0 percent propylene glycol and about 2.0 percent dipropylene glycol monomethyl ether; and (D) the balance water.

* * * * *

UNITED STATES PATENT OFFICE

CERTIFICATE OF CORRECTION

PATENT NO. : 4,948,531

DATED : August 14, 1990

INVENTOR(S) : Cynthia L. Fuggini et al

It is certified that error appears in the above-identified patent and that said Letters Patent is hereby corrected as shown below:

Col. 9, line 60, Formula IVb reading:

$$\text{"}\ R_3CONH(CH_2)_m-\overset{\overset{CH_3}{|}}{\underset{\underset{CH_3}{|}}{N^+}}-CH_2COO^-\ \text{"}$$

should read:

$$\text{--}R_5CONH(CH_2)_m-\overset{\overset{CH_3}{|}}{\underset{\underset{CH_3}{|}}{N^+}}-CH_2COO^-\text{--}$$

Signed and Sealed this

Tenth Day of December, 1991

*Attest:*

HARRY F. MANBECK, JR.

*Attesting Officer*

*Commissioner of Patents and Trademarks*